US006412596B1

(12) United States Patent
Brandt et al.

(10) Patent No.: US 6,412,596 B1
(45) Date of Patent: Jul. 2, 2002

(54) PROCESS FOR FILLING A MUFFLER AND MUFFLER FILLED WITH FIBROUS MATERIAL

(75) Inventors: Luc Brandt, Henri-Chapelle; Leon Charlier, Bettice, both of (BE)

(73) Assignee: Owens Corning Composites SPRL, Brussels (BE)

( * ) Notice: Subject to any disclaimer, the term of this patent is extended or adjusted under 35 U.S.C. 154(b) by 0 days.

(21) Appl. No.: 09/775,759

(22) Filed: Feb. 1, 2001

(51) Int. Cl.[7] ..... F01N 1/24
(52) U.S. Cl. ..... 181/256; 181/252; 181/257
(58) Field of Search ..... 181/256, 252, 181/257, 258

(56) References Cited

U.S. PATENT DOCUMENTS

| | | | | |
|---|---|---|---|---|
| 3,921,273 | A | | 11/1975 | Kondo et al. |
| 3,964,528 | A | * | 6/1976 | Smithson et al. ..... 141/67 |
| 4,282,017 | A | * | 8/1981 | Chen ..... 96/332 |
| 4,569,471 | A | | 2/1986 | Ingemansson et al. |
| RE32,258 | E | | 10/1986 | Kondo et al. |
| 4,774,985 | A | | 10/1988 | Broadbelt et al. |
| 5,036,585 | A | | 8/1991 | Schweinfurth |
| 5,398,407 | A | | 3/1995 | Stuer |
| 5,461,777 | A | | 10/1995 | Ikeda et al. |
| 5,479,706 | A | | 1/1996 | Tamano et al. |
| 5,766,541 | A | | 6/1998 | Knutsson et al. |
| 5,784,784 | A | | 7/1998 | Flanigan et al. |
| 5,976,453 | A | | 11/1999 | Nilsson et al. |
| 6,053,276 | A | | 4/2000 | D'Amico, Jr. et al. |
| 6,068,082 | A | | 5/2000 | D'Amico, Jr. et al. |
| 6,094,817 | A | | 8/2000 | Shah et al. |
| 6,148,519 | A | | 11/2000 | Stenersen et al. |
| 6,158,547 | A | | 12/2000 | Ackermann et al. |

FOREIGN PATENT DOCUMENTS

JP 11013450 * 1/1999

OTHER PUBLICATIONS

Lewin, Pending Serial No. 09/811,222, (Mar. 16, 2001).
Brandt, US Pending 09/952,004, (Sep. 12, 2001),.

* cited by examiner

*Primary Examiner*—Shih-Yung Hsieh
(74) *Attorney, Agent, or Firm*—Inger H. Eckert; Stephen W. Barns

(57) ABSTRACT

A process is provided for filling a muffler with fibrous material as well as a muffler filled with fibrous material. The process includes a first step of providing a muffler comprising a closed outer shell having an inner cavity and a perforated pipe. The perforated pipe has a first end portion with at least one fill opening. A second step comprises feeding fibrous material into the outer shell inner cavity through the at least one fill opening in the perforated pipe to form a fibrous product in the outer shell.

24 Claims, 7 Drawing Sheets

PROCESS FOR FILLING A MUFFLER AND MUFFLER FILLED WITH FIBROUS MATERIAL

TECHNICAL FIELD AND INDUSTRIAL APPLICABILITY OF THE INVENTION

This invention relates to a process for filling a muffler with fibrous material as well as a muffler filled with fibrous material.

BACKGROUND OF THE INVENTION

U.S. Pat. No. 4,569,471 to Ingemansson et al. describes a process and apparatus for feeding lengths of a continuous glass fiber strand into a muffler outer shell. The apparatus includes a nozzle for expanding the fiber strand into a wool-like material before the material enters the outer shell. In a first embodiment, filling of an outer cylinder 14 of the muffler shell occurs without an end-piece joined to the outer cylinder 14. After the filling operation is completed, the outer cylinder 14 is moved to a separate station where the end piece is welded onto the outer cylinder 14. During movement of outer cylinder 14, a vacuum device may remain coupled to the outer cylinder 14 or a cover is placed over the filled outer cylinder 14 so as to prevent the wool-like material from coming out during transport, see column 4, lines 1–7. During the closure process, great care must be taken to ensure that glass fiber material does not extend into the joint area.

In a second embodiment, illustrated in FIG. 3, a perforated pipe/outer end piece assembly is positioned only part way into the muffler outer cylinder 14 during the glass material filling operation. After the filling operation has been completed, the perforated pipe/end piece assembly is moved to its final position within the outer cylinder 14.

There is a need for a muffler outer shell filling process which can be implemented using a closed muffler shell such that after a glass material filling operation has been completed, muffler shell components do not have to welded or otherwise joined together.

SUMMARY OF THE INVENTION

This need is met by the present invention, wherein a process is provided for filling a closed muffler shell with fibrous material through a fill opening provided in a perforated pipe extending at least part way through the muffler shell. Alternatively, an end of the perforated pipe may be positioned within the muffler shell a spaced distance from an opening in the shell such that the fibrous material is fed into the muffler shell via a gap defined between the perforated pipe end and a portion of the closed shell defining the opening.

In accordance with a first aspect of the present invention, a process is provided for filling a muffler with fibrous material. The process comprises the steps of: providing a muffler comprising a closed outer shell having an inner cavity and a first perforated pipe, the perforated pipe having a first end portion with at least one fill opening; and feeding fibrous material into the outer shell inner cavity through the at least one fill opening in the perforated pipe to form a fibrous product in the outer shell.

The fill opening may be formed via drilling, sawing, during the pipe forming process via a molding or stamping process or via any other conventional process for forming an opening in a pipe.

The feeding step may comprise the steps of: providing a nozzle; feeding continuous strand material and pressurized air into the nozzle such that a wool-type product emerges from the nozzle; and positioning the nozzle adjacent to or in the fill opening such that the wool-type product is fed into the outer shell inner cavity.

The continuous strand material comprises one more strands each comprising a plurality of glass filaments which may be selected from the group consisting of E-glass filaments and S-glass filaments. Preferably, the continuous strand material comprises an E-glass roving sold by Owens Corning under the trademark ADVANTEX® or an S-glass roving sold by Owens Corning under the trademark Zentron®.

In one embodiment, the perforated pipe may comprise a second end portion and the process may further comprise the step of drawing a partial vacuum in the outer shell inner cavity through the second end portion of the pipe during the feeding step.

In another embodiment, the muffler further comprises a second perforated pipe having an end portion, and the process further comprises the step of drawing a partial vacuum in the outer shell through the end portion of the second pipe during the feeding step.

The second perforated pipe may further include at least one fill opening in its end portion and the process additionally comprises the step of feeding fibrous material into the outer shell inner cavity through the at least one fill opening in the second perforated pipe. The process may further comprise the step of drawing a partial vacuum in the outer shell through the first end portion of the first pipe during the step of feeding fibrous material through the at least one fill opening in the second perforated pipe.

The first perforated pipe may comprise two or more fill openings and the fibrous material is fed into the outer shell inner cavity through the two or more fill openings. Feeding of the fibrous material through the two or more fill openings may occur sequentially or concurrently.

The perforated pipe preferably has a plurality of first openings of a first dimension which define the perforations in the pipe. The at least one fill opening may have a second dimension which is greater in size than the first dimension.

In accordance with a second aspect of the present invention, a process is provided for filling a muffler with fibrous material. The process comprises a first step of providing a muffler comprising a closed outer shell having an inner cavity and a first perforated pipe. The perforated pipe has a first end spaced from an opening in a first sidewall of the outer shell. A portion of the outer shell defining the first sidewall opening and the first pipe end define a gap therebetween. A second step comprises feeding fibrous material into the outer shell inner cavity through the gap to form a fibrous product in the outer shell.

The feeding step may comprise the steps of: providing a nozzle; feeding continuous strand material and pressurized air into the nozzle such that a wool-type product emerges from the nozzle; and positioning the nozzle adjacent to or in the gap such that the wool-type product is fed into the outer shell inner cavity.

In accordance with a third aspect of the present invention, a muffler is provided comprising a closed outer shell inner cavity, and a first perforated pipe extending at least part way through the closed outer shell. The perforated pipe has an end portion provided with at least one first fill opening adapted to receive fibrous material.

The muffler may further comprise a second perforated pipe having an end portion with at least one second fill opening. The muffler outer shell may comprise at least one internal partition for defining first and second internal compartments in the outer shell inner cavity. The first internal compartment is adapted to receive fibrous material through the at least one first fill opening and the second internal compartment is adapted to receiving fibrous material through the at least one second fill opening.

In accordance with a fourth aspect of the present invention, a muffler is provided comprising a closed outer shell having an inner cavity, a first perforated pipe extending through the closed outer shell, and fibrous material in the outer shell defining a fibrous product in the outer shell. The perforated pipe has an end portion provided with at least one first fill opening. The fibrous material entered into the outer shell inner cavity through the at least one fill opening.

The muffler may further comprise a second perforated pipe having an end portion with at least one second fill opening. The muffler outer shell may include at least one internal partition for defining first and second internal compartments in the outer shell inner cavity. The first internal compartment has fibrous material fed through the at least one first fill opening and the second internal compartment has fibrous material fed through the at least one second fill opening.

It is contemplated that the muffler outer shell may have at least two internal partitions defining first, second and third internal compartments in the outer shell inner cavity. The first internal compartment has fibrous material fed through the at least one first fill opening, the second internal compartment has fibrous material fed through the at least one second fill opening, and the third internal compartment is positioned between the first and second compartments and has substantially no fibrous material therein.

DETAILED DESCRIPTION AND PREFERRED EMBODIMENTS OF THE INVENTION

A process is provided for filling a muffler with fibrous material. Mufflers filled in accordance with the present invention are capable of being incorporated into vehicle exhaust systems and function as acoustic attenuators.

Figure 1:
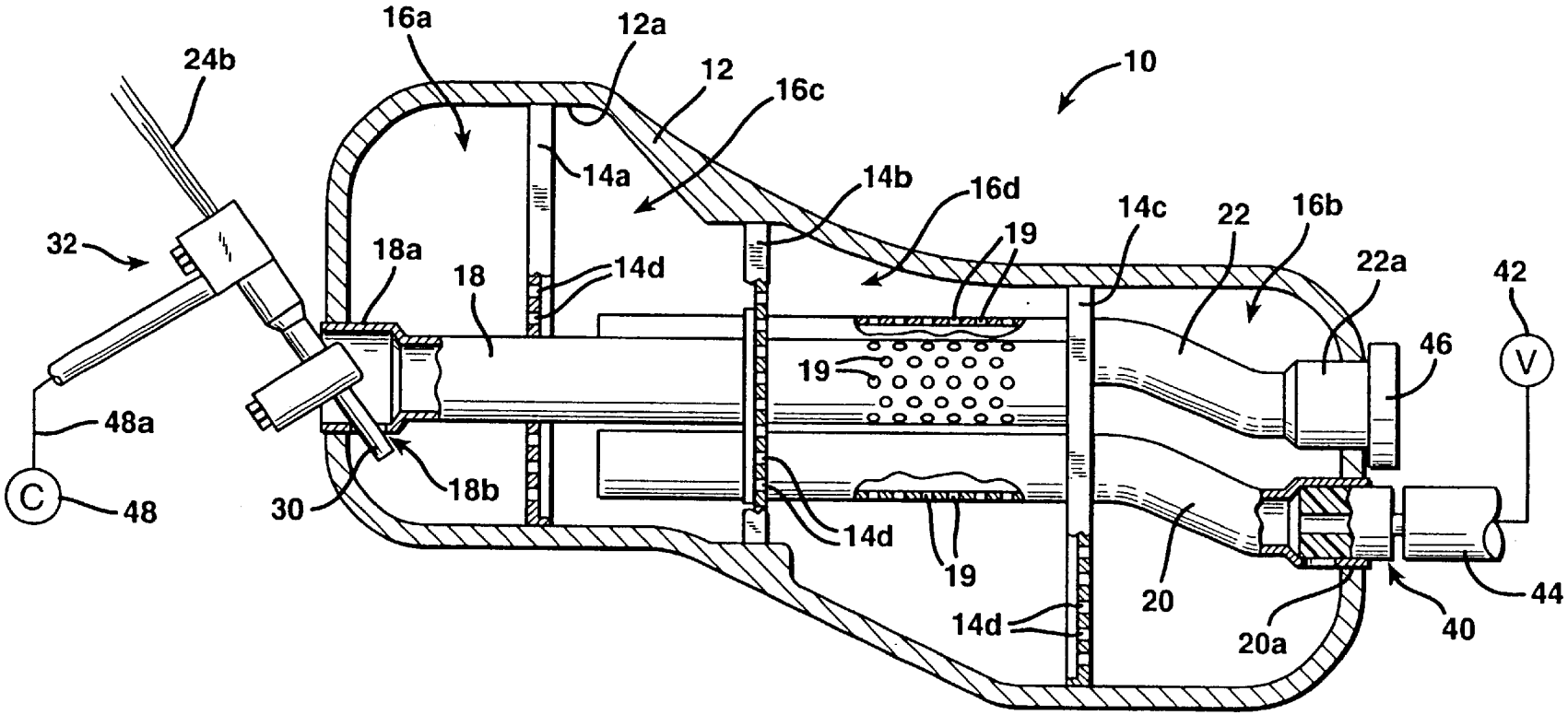
FIG. 1 illustrates a muffler constructed in accordance with a first embodiment of the present invention having an outer shell shown partially in cross-section and with portions partially removed and a first perforated pipe with a fill opening into which a fibrous material filling nozzle extends.
Figure 2:
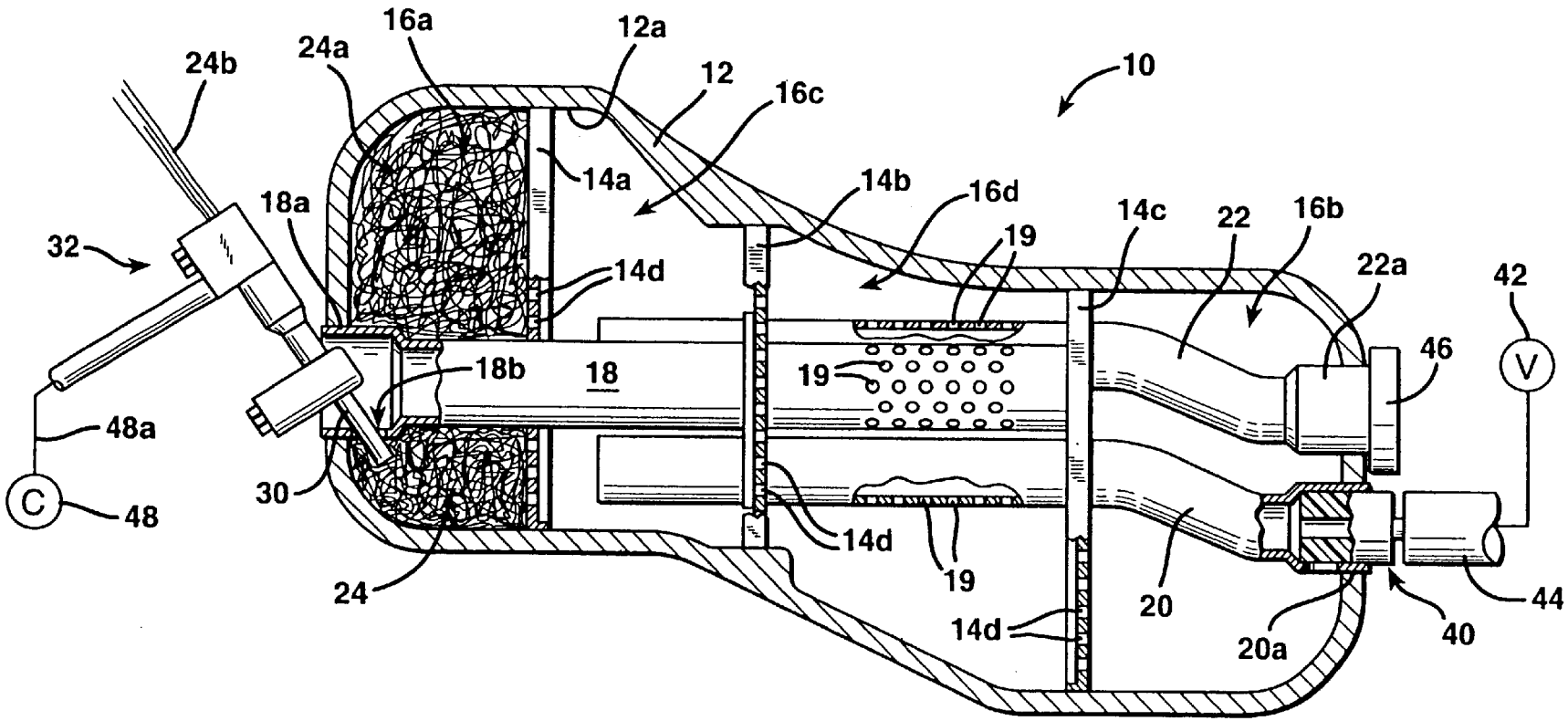
FIG. 2 is a view of the muffler shown in FIG. 1 illustrating fibrous material having been fed by the nozzle into a first compartment of the muffler.

In FIG. 1, a muffler 10 is illustrated which is capable of being filled in accordance with a first embodiment of the present invention. The muffler 10 comprises a closed outer shell 12 having first, second and third partitions 14*a*–14*c* which define first, second, third and fourth internal compartments 16*a*–16*d* of an inner cavity 12*a* within the muffler shell 12. A "closed muffler shell" as used herein means a single element muffler shell or a shell formed from two or more elements which are welded or otherwise coupled together such that they are not intended to be opened after a fibrous material filling operation. The muffler 10 further comprises first, second and third perforated pipes 18, 20 and 22. In the illustrated embodiment, the partitions 14*a*–14*c* include a plurality of openings 14*d* permitting gases to pass between the compartments 16*a*–16*d*. Further in the illustrated embodiment, the first, second and third pipes 18, 20 and 22 include first openings 19 having a cross sectional area of from about 7.0 $mm^2$ to about 25.0 $mm^2$. The openings 19 in the pipes 18, 20 and 22 allow gases to pass into one or more of the compartments 16*a*–16*d*. As will be discussed below, the first and second compartments 16*a* and 16*b* are filled with a fibrous material 24 which defines a wool-type product 24*a* in those compartments 16*a* and 16*b*. During operation of a vehicle to which the muffler 10 is coupled, acoustic energy passes through and from the perforated pipes 18, 20 and 22 to the wool-type product 24*a* which functions to dissipate a portion of the acoustic energy. The product 24*a* may potentially function to thermally insulate the outer shell 12 from energy in the form of heat transferred from high temperature exhaust gases passing through the pipes 18, 20 and 22.

It is contemplated that any closed muffler shell configuration may be used in accordance with the present invention. For example, the muffler shell 12 may include zero internal partitions, one partition, two partitions or four or more partitions. The partitions may be provided with or without openings for gases to pass therethrough. The muffler shell 12 may also comprise a single perforated pipe, two perforated pipes or four or more perforated pipes.

In the illustrated embodiment, the pipes 18, 20 and 22 pass through openings provided in the partitions 14*a*–14*c*. The pipes 18, 20 and 22 may be secured to the partitions 14*a*–14*c* via an adhesive, spotted welding or may be press-fitted into the partition openings such that they are frictionally held in the partitions 14*a*–14*c*.

The first pipe 18 is provided with a flared or expanded end portion 18*a* having a fill opening 18*b* extending completely through the end portion 18*a*. The fill opening 18*b* and the expanded end portion 18*a* are sized so as to accommodate a nozzle 30 of a conventional texturizing device 32. Such a device 32 is disclosed in U.S. Pat. Nos. 4,569,471 and 5,976,453, the disclosures of which are incorporated herein by reference. In the illustrated embodiment, the expanded end portion 18*a* and the fill opening 18*b* have generally circular cross sections. The internal diameter of the expanded end portion 18*a* may be from about 30 mm to about 80 mm and preferably about 55 mm. The diameter of the fill opening 8*b* may be from about 14 mm to about 25 mm and preferably about 18 mm. A non-circular end portion 18*a* and/or a non-circular fill opening 18*b* having cross-sectional areas substantially equal to the above-discussed circular end portion 18*a* and fill opening 18*b* may also be used.

To fill the first compartment 16*a* with fibrous material 24, the nozzle 30 is inserted into the fill opening 18*b*, see FIGS.

1, 2 and 5. Further, a vacuum adapter 40, coupled to a vacuum source 42 via a hose 44, is inserted into an end portion 20*a* of the second pipe 20. A plug 46 is inserted into an end portion 22*a* of the third tube 22 so as to prevent air or gases from entering or leaving the muffler shell 12 through the third tube 22. When the vacuum source 42 is activated, a partial vacuum is created within the outer shell 12 through the second pipe 20. Prior to or after activation of the vacuum source 42, continuous strand material 24*b* and pressurized air are supplied to the texturizing device 32. The pressurized air is supplied from a conventional compressor 48 which communicates with the device 32 via a hose 48*a*. The continuous strand material 24*b* comprises one more strands each which may comprise a plurality of glass filaments selected from the group consisting of E-glass filaments and S-glass filaments. Preferably, the continuous strand material comprises a roving sold by Owens Coming under the trademark ADVANTEX® or the trademark Zentron®. The pressurized air separates and entangles the filaments of the strand material 24*b* so that the strand material emerges from the nozzle 30 as a continuous length of "fluffed-up" or fibrous material 24. Once the fibrous material 24 fills the compartment 16*a*, it defines a wool-type product 24*a* in that compartment 16*a*.

Figure 3:
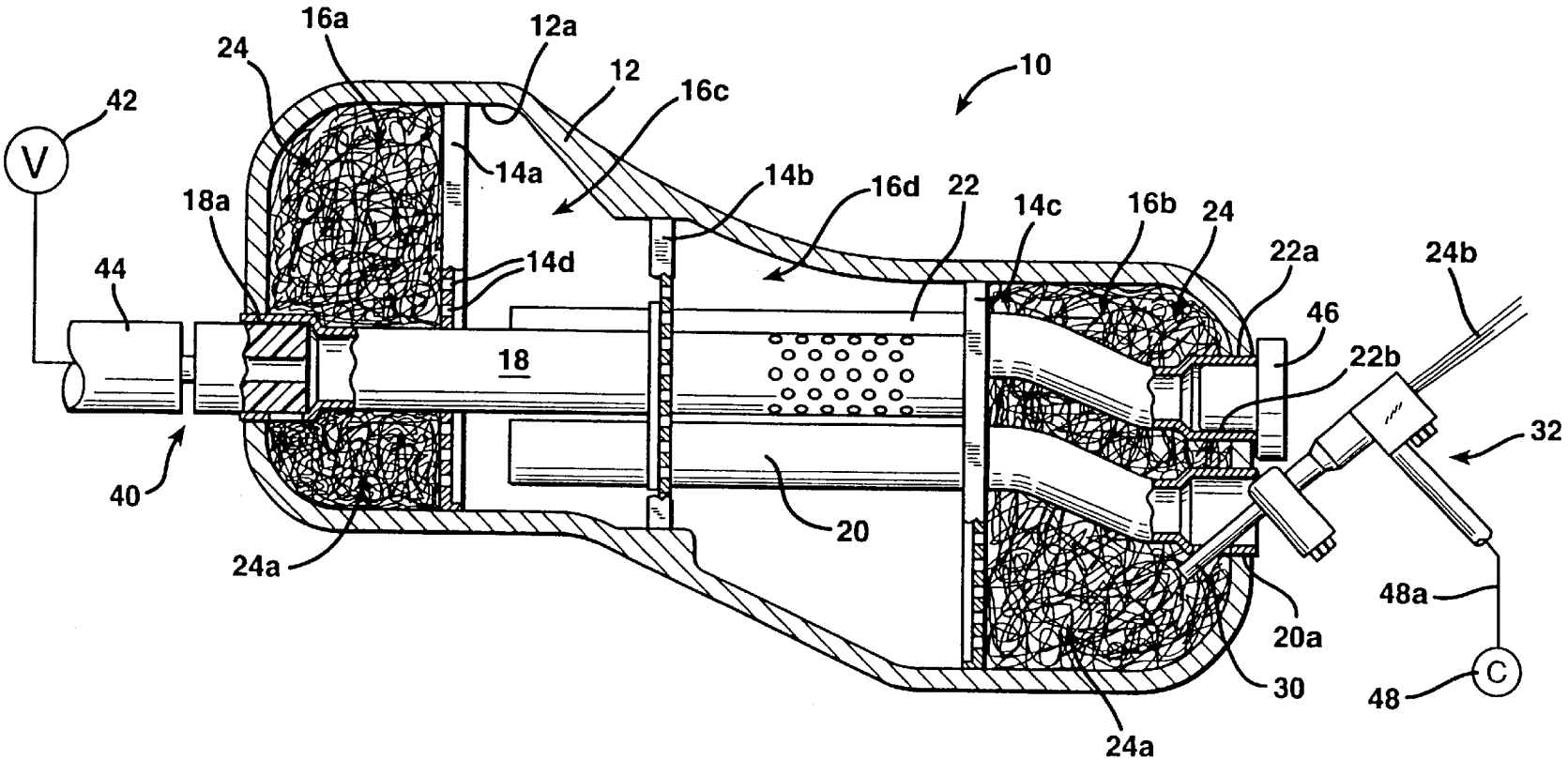
FIG. 3 is a view of the muffler shown in FIG. 1, illustrating fibrous material having been fed by the nozzle into a second compartment of the muffler through a fill opening provided in a second perforated pipe.
Figure 4:
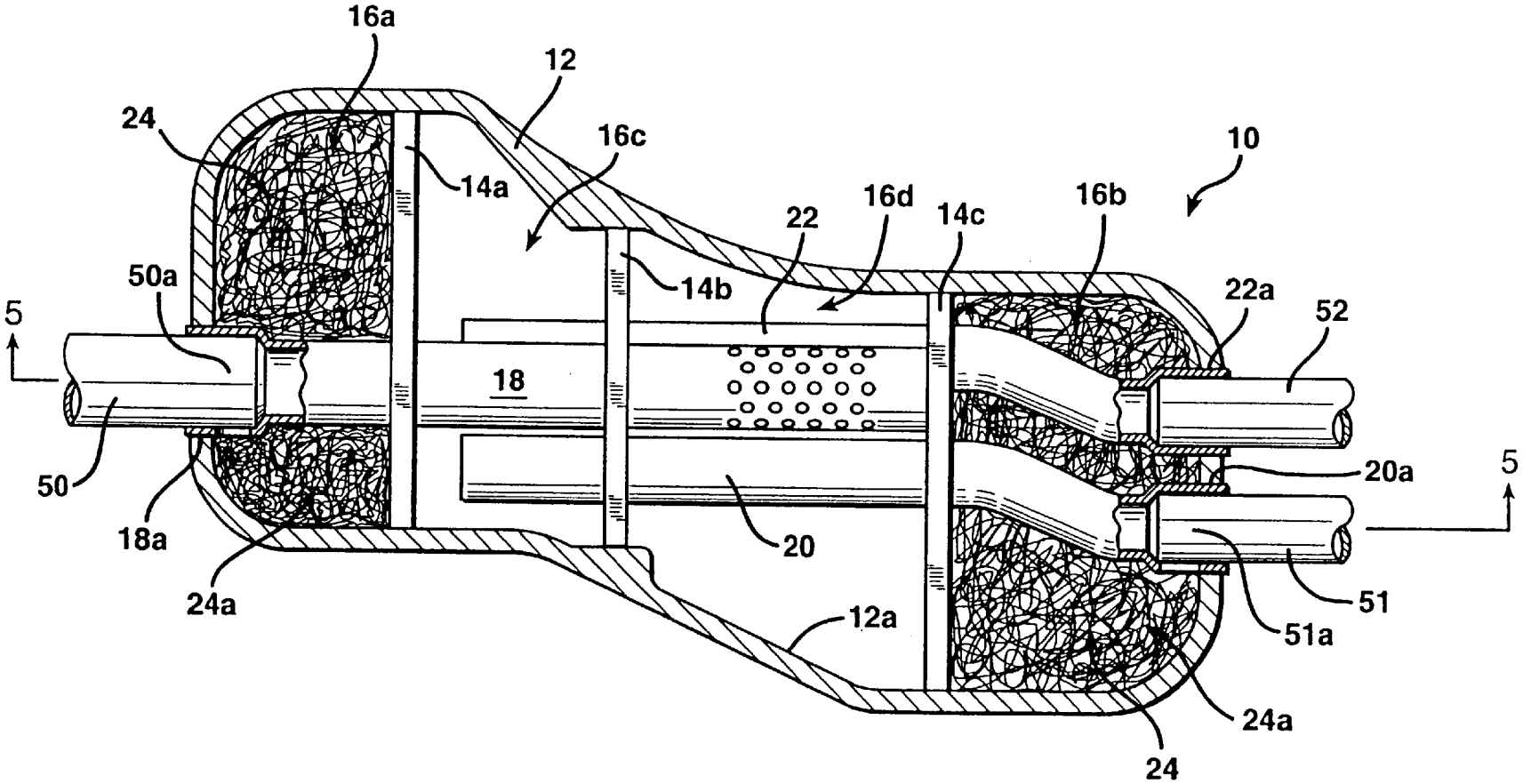
FIG. 4 is a view of the muffler shown in FIG. 1 with exhaust pipes fitted within perforated pipes of the muffler.
Figure 5:
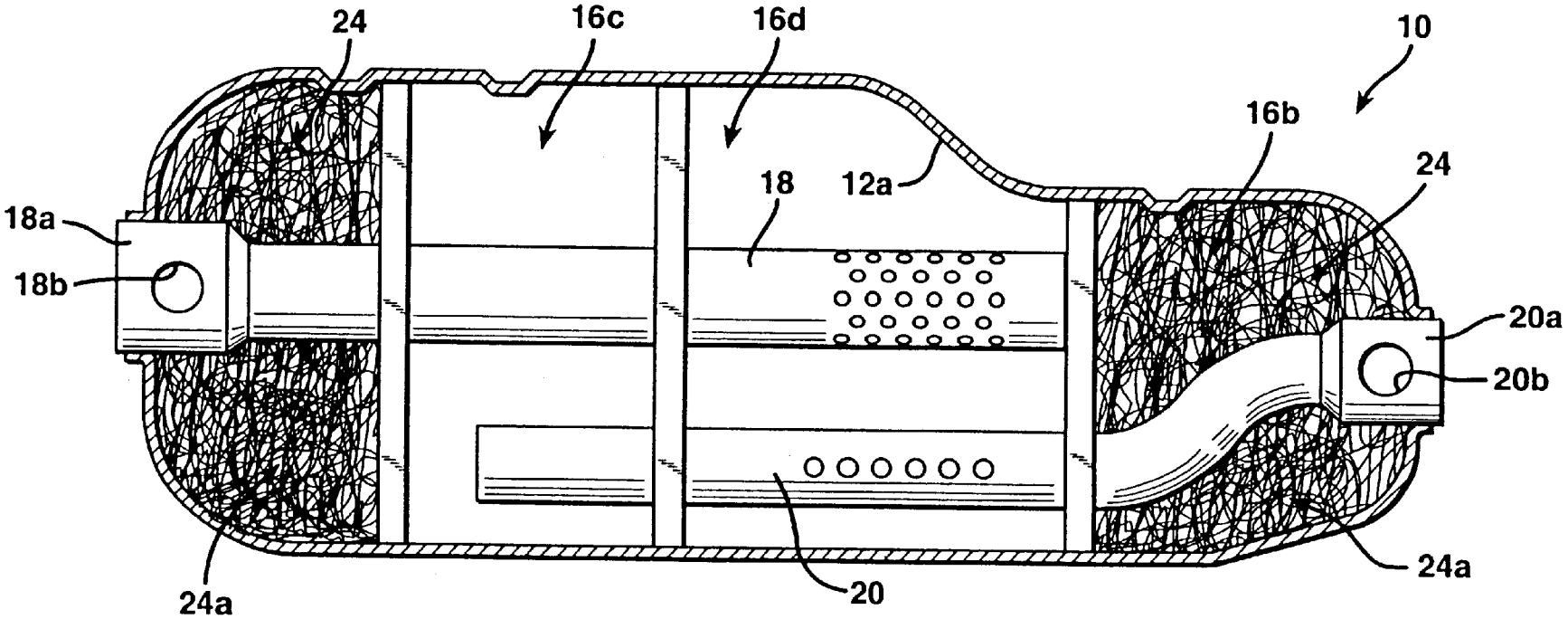
FIG. 5 is a view taken along view line 5—5 in FIG. 4.

To fill the second compartment 16*b* with fibrous material 24, the nozzle 30 is inserted into a fill opening 20*b* provided in the end portion 20*a* of the second pipe 20, see FIGS. 3 and 5. The vacuum adapter 40 is inserted into the first pipe end portion 18*a*. The plug 46 remains in the end portion 22*a* of the third tube 22 so as to prevent air or gases from entering or leaving the muffler shell 12 through the third tube 22. The vacuum source 42 is activated and continuous strand material 24*b* and pressurized air are supplied to the texturizing device 32. Fibrous material 24 exiting the nozzle 30 fills the second compartment 16*b*. The fibrous material 24 defines a wool-type product 24*a* in the second compartment 16*b*. It is also contemplated that the second compartment 16*b* could be filled by placing the plug 46 in the end portion 20*a* of the second pipe 20 while supplying the pressurized gases and fibrous material 24 through a fill opening 22*b* in the end portion 22*a* of the third tube 22.

A sufficient quantity of fibrous material 24 is provided in the compartments 16*a* and 16*b* so as to allow the muffler 10 to adequately perform its acoustic energy attenuation and thermal insulation functions. The compartments 16*a* and 16*b* may be filled with fibrous material 24 having a density of from about 80 grams/liter to about 200 grams/liter and preferably about 100 grams/liter.

After the compartments 16*a* and 16*b* have been filled with fibrous material 24 and first, second and third exhaust pipes 50–52 are inserted into the end portions 18*a*, 20*a* and 22*a* of the first, second and third pipes 18, 20 and 22, the muffler 12 is installed in a vehicle. End portions 50*a* and 51*a* of the first and second exhaust pipes 50 and 51 function not only to provide conduits for exhaust gases to flow into and out of the muffler 10, they also function to close off the fill openings 18*b* and 20*b* provided in the first and second pipes 18 and 20.

In the event that the exhaust pipe end portions 50*a* and 51 a are not inserted into the end portions 18*a* and 20*a* of the first and second perforated pipes 18 and 20, it is contemplated that the fill openings 18*b* and 20*b* may be closed via plugs (not shown) which are inserted into the openings 18*b* and 20*b*. The plugs may be welded or adhesively secured in place.

Figure 6:
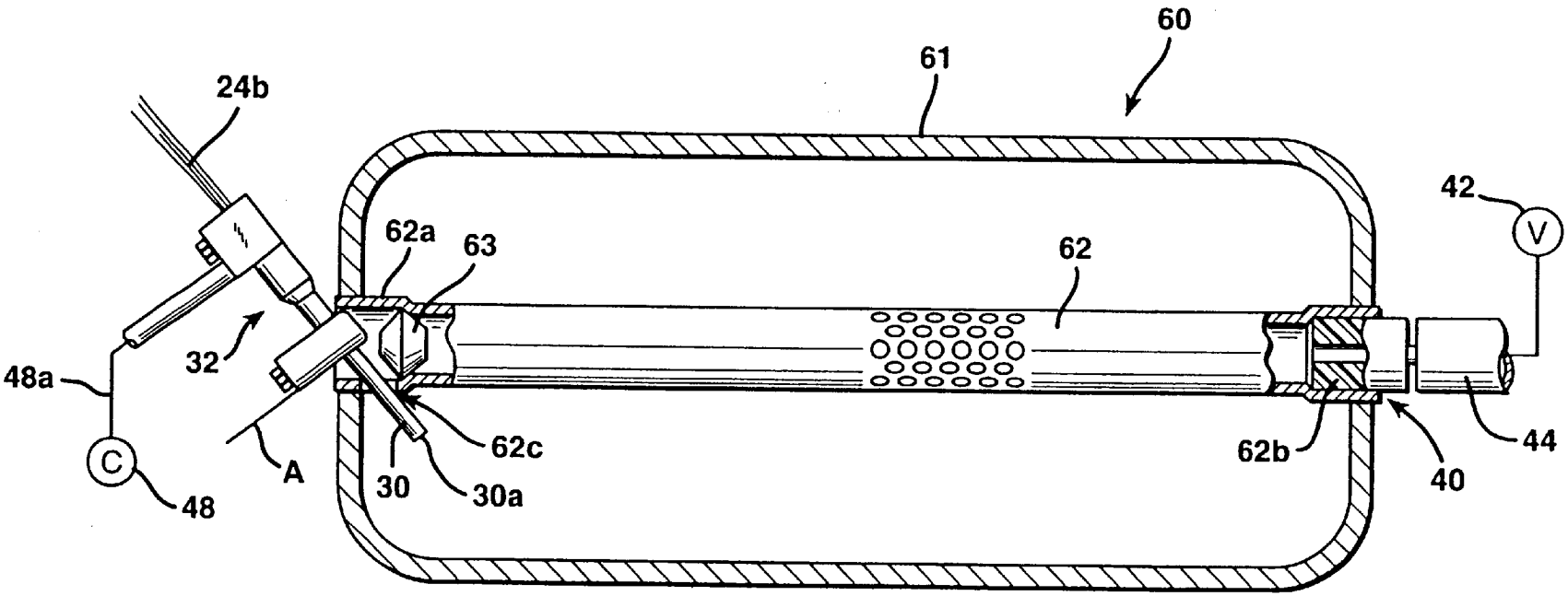
FIG. 6 is a view of a muffler having an outer shell shown in cross-section and a single perforated pipe with a fill opening into which a fibrous material filling nozzle extends.

In FIG. 6, a muffler 60 comprising an outer shell 61 and only a single perforated pipe 62 is illustrated. The pipe 62 has first and second end portions 62*a* and 62*b*. A nozzle 30 of a texturizing device 32, such as the one discussed above, is shown inserted into a fill opening 62*c* provided in the first end portion 62*a* of the pipe 62. The vacuum adapter 40, discussed above, is inserted into the second end portion 62*b* of the pipe 62. A plug 63 is inserted into the first end portion 62*a* so as to prevent air from being drawn in through the end portion 62*a* when the vacuum source 42 is activated. Continuous strand material 24*b* and pressurized air are supplied to the texturizing device 32 and the vacuum source 42 is activated so as to fill the shell 61 with fibrous material 24 (not shown).

It is contemplated that pipe end portions 18*a*, 20*a* and 62*a* may be provided with two or more fill openings 18*b*, 20*b* and 62*b*. When two or more fill openings are provided, fibrous material 24 may be supplied through those openings either sequentially or concurrently. If supplied sequentially, only a single texturizing device 32 need be provided. If two openings are supplied with fibrous material 24 concurrently, two texturizing devices 32 may be provided. The nozzles 30 on the devices 32 may have a length less than or equal to about 100 mm as measured from plane A to end 30*a* of a nozzle 30, see FIG. 6.

Figure 7:
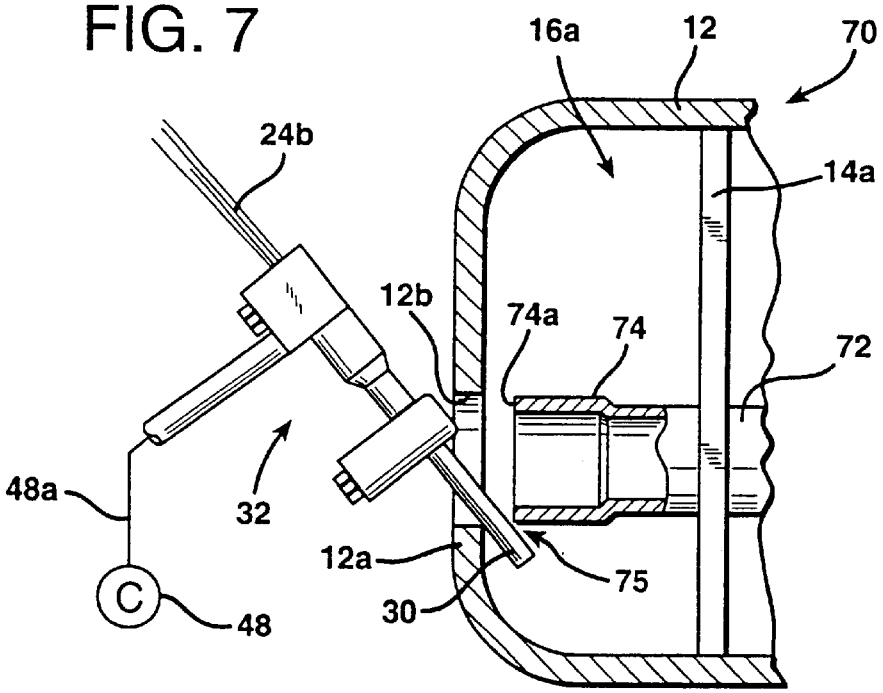
FIG. 7 is a view of a muffler constructed in accordance with a second embodiment of the present invention having an outer shell shown partially in cross-section and a first perforated pipe having an end spaced from an opening in the muffler outer shell such that a gap is defined between the first pipe end and a portion of the muffler shell and wherein a fibrous material filling nozzle is shown extending into the gap.

A process for filling a muffler with fibrous material in accordance with a second embodiment of the present invention is illustrated in FIG. 7, where like reference numerals indicate like elements. In FIG. 7, a muffler 70 is provided having an outer shell 12. A perforated pipe 72 having an end portion 74 and an end 74*a* is positioned within the outer shell 12. The end 74*a* is spaced from a portion 12*a* of the outer shell defining an opening 12*b* in the outer shell 12. In this embodiment, the nozzle 30 of a texturizing device 32, such as the one discussed above, is inserted into a gap 75 defined by the end 74*a* of the pipe 72 and the portion 12*a* of the outer shell 12. A compartment 16*a* of the outer shell 12 is filled by supplying continuous strand material 24*b* and pressurized air to the texturizing device 32. Preferably, a partial vacuum is created within the outer shell 12. After the compartment 16*a* in the outer shell 12 is filled with fibrous material (not shown), an exhaust pipe (not shown) is inserted into the end portion 74. The opening 12*b* in the outer shell 12 is sized to be only slightly larger than the outer diameter of the exhaust pipe so as to seal the fibrous material 24 within the compartment 16*a*.

Figure 7A:
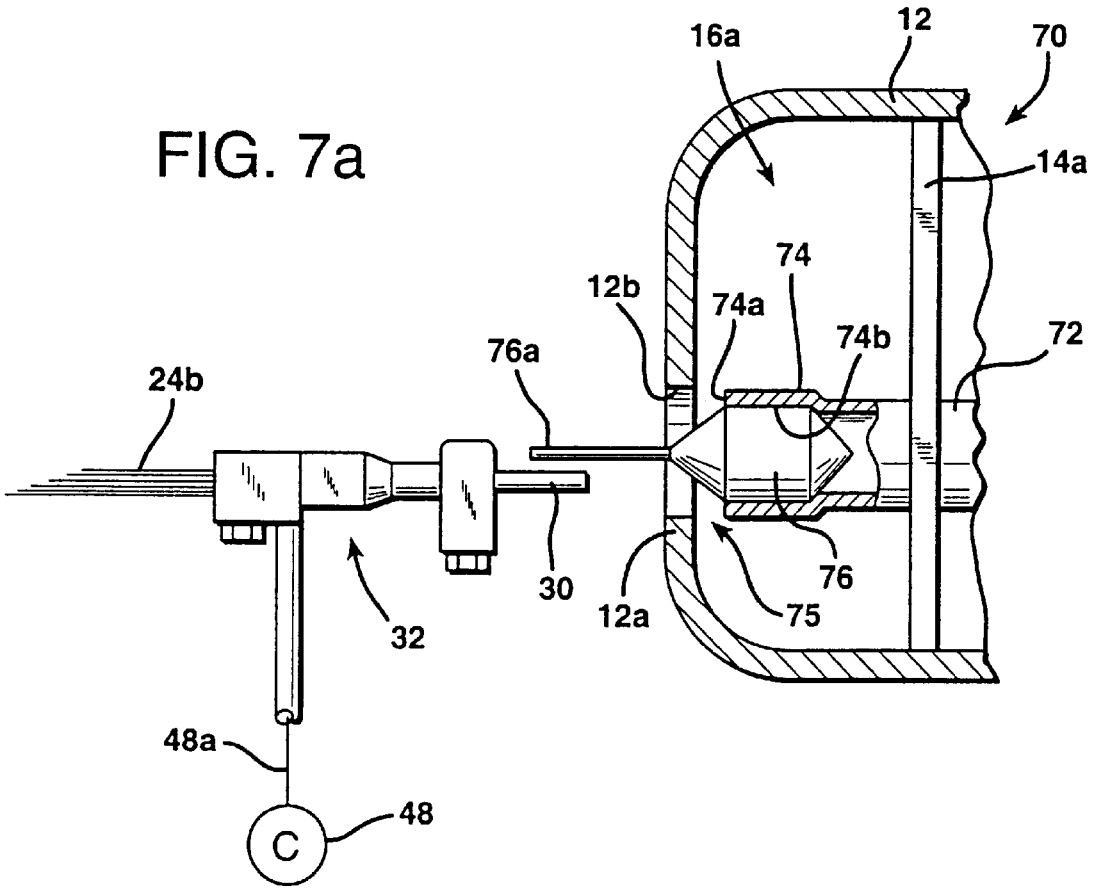
FIG. 7*a* is a view similar to FIG. 7 showing a plug inserted into an end portion of the perforated pipe.

In FIG. 7*a*, a plug 76 is provided in an opening 74*b* of the end portion 74 so as to prevent gases from being drawn into the pipe 72 through the end portion 74. The plug 76 is provided with an extension 76*a* which acts as a guide for gases and fibrous material supplied toward gap 75. In this embodiment, the nozzle 30 may be positioned outside of the outer shell 12. The gases and fibrous material enter into the compartment 16*a* through the gap 75.

What is claimed is:

1. A process for filling a muffler with fibrous material comprising the steps of:

providing a muffler comprising a closed outer shell having an inner cavity and a first perforated pipe, said perforated pipe having a first end portion with at least one fill opening; and feeding fibrous material into said outer shell inner cavity through said at least one fill opening in said perforated pipe to form a fibrous product in said outer shell.

2. A process as set forth in claim 1, wherein said feeding step comprises the steps of:

providing a nozzle;

feeding continuous strand material and pressurized air into said nozzle such that a wool-type product emerges from said nozzle; and positioning said nozzle adjacent to or in said fill opening such that said wool-type product is fed into said outer shell inner cavity.

3. A process as set forth in claim 2, wherein said continuous strand material comprises one more strands each comprising a plurality of glass filaments selected from the group consisting of E-glass filaments and S-glass filaments.

4. A process as set forth in claim 1, wherein said perforated pipe comprises a second end portion and said process further comprises the step of drawing a partial vacuum in said outer shell through said second end portion of said pipe during said feeding step.

5. A process as set forth in claim 1, wherein said muffler further comprises a second perforated pipe having an end portion, and said process further comprises the step of drawing a partial vacuum in said outer shell through said end portion of said second pipe during said feeding step.

6. A process as set forth in claim 5, wherein said second perforated pipe further includes at least one fill opening in its end portion and said process further comprises the step of feeding fibrous material into said outer shell inner cavity through said at least one fill opening in said second perforated pipe.

7. A process as set forth in claim 6, wherein said process further comprises the step of drawing a partial vacuum in said outer shell through said first end portion of said first pipe during the step of feeding fibrous material through said at least one fill opening in said second perforated pipe.

8. A process as set forth in claim 1, wherein said first perforated pipe comprises two or more fill openings and said fibrous material is fed into said outer shell inner cavity through said two or more fill openings.

9. A process as set forth in claim 8, wherein said fibrous material is concurrently fed into said two or more openings.

10. A process as set forth in claim 1, wherein said perforated pipe further having a plurality of first openings of a first dimension defining perforations in said pipe, said at least one fill opening have a second dimension which is greater in size than said first dimension.

11. A process for filling a muffler with fibrous material comprising the steps of:

providing a muffler comprising a closed outer shell having an inner cavity and a first perforated pipe, said perforated pipe having a first end spaced from an opening in a first side wall of said outer shell, a portion of said outer shell defining said first side wall opening and said first pipe end defining a gap therebetween; and feeding fibrous material into said outer shell inner cavity through said gap to form a fibrous product in said outer shell.

12. A process as set forth in claim 11, wherein said feeding step comprises the steps of:

providing a nozzle;

feeding continuous strand material and pressurized air into said nozzle such that a wool-type product emerges from said nozzle; and positioning said nozzle adjacent to or in said gap such that said wool-type product is fed into said outer shell inner cavity.

13. A process as set forth in claim 12, wherein said continuous strand material comprises one or more strands each comprising a plurality of glass filaments selected from the group consisting of E-glass filaments and S-glass filaments.

14. A process as set forth in claim 11, wherein said perforated pipe comprises a second end portion and said process further comprises the step of drawing a partial vacuum in said outer shell through said second end portion of said pipe during said feeding step.

15. A process as set forth in claim 11, wherein said muffler further comprises a second perforated pipe having an end portion, and said process further comprises the step of drawing a partial vacuum in said outer shell through said end portion of said second pipe during said feeding step.

16. A muffler comprising:

a closed outer shell; and a first perforated pipe extending at least part way through said closed outer shell, said perforated pipe having an end portion provided with at least one first fill opening adapted to receive fibrous material.

17. A muffler as set forth in claim 16, further comprising a second perforated pipe having an end portion with at least one second fill opening.

18. A muffler as set forth in claim 17, wherein said outer shell includes at least one internal partition for defining first and second internal compartments in said outer shell, said first internal compartment being adapted to receive fibrous material through said at least one first fill opening and said second internal compartment being adapted to receiving fibrous material through said at least one second fill opening.

19. A muffler as set forth in claim 16, where said first perforated pipe further includes a plurality of first openings of a first dimension defining perforations in said pipe and at least one second opening of a second dimension which is greater in size than said first dimension and defining said at least one first fill opening.

20. A muffler comprising:

a closed outer shell having an inner cavity; and a first perforated pipe extending through said closed outer shell, said perforated pipe having an end portion provided with at least one first fill opening;

fibrous material in said outer shell defining a fibrous product in said outer shell, said fibrous material having been fed into said outer shell inner cavity through said at least one fill opening.

21. A muffler as set forth in claim 20, further comprising a second perforated pipe having an end portion with at least one second fill opening.

22. A muffler as set forth in claim 21, wherein said outer shell includes at least one internal partition for defining first and second internal compartments in said outer shell inner cavity, said first internal compartment having fibrous material fed through said at least one first fill opening and said second internal compartment having fibrous material fed through said at least one second fill opening.

23. A muffler as set forth in claim 21, wherein at least two internal partitions are provided in said outer shell defining first, second and third internal compartments in said outer shell inner cavity, said first internal compartment having fibrous material fed through said at least one first fill opening, said second internal compartment having fibrous material fed through said at least one second fill opening, and said third internal compartment positioned between said first and second compartments and having no fibrous material therein.

24. A muffler as set forth in claim 20, wherein said first perforated pipe further includes a plurality of first openings of a first dimension defining perforations in said pipe and at least one second opening of a second dimension which greater in size than said first dimension and defining said at least one first fill opening.

* * * * *